US005522848A

United States Patent [19]

Kamali

[11] Patent Number: 5,522,848

[45] Date of Patent: Jun. 4, 1996

[54] LUMINESCENT PACIFIER

[76] Inventor: Helen Kamali, 3757 Hayvenhurst Ave., Encino, Calif. 91436

[21] Appl. No.: 529,339

[22] Filed: Sep. 18, 1995

[51] Int. Cl.[6] ..... A61J 17/00

[52] U.S. Cl. ..... 606/234

[58] Field of Search ..... 606/234–236; D24/194–198; 446/219

[56] References Cited

U.S. PATENT DOCUMENTS

| | | | |
|---|---|---|---|
| 3,186,411 | 6/1965 | Skidmore | 606/236 |
| 4,688,571 | 8/1987 | Tesler | 606/234 |
| 5,007,924 | 4/1991 | Jekel | 606/234 |
| 5,292,335 | 3/1994 | Shin | 606/234 |

*Primary Examiner*—Gary Jackson
*Assistant Examiner*—Glenn Dawson
*Attorney, Agent, or Firm*—Roger A. Marrs

[57] ABSTRACT

A pacifier for an infant is disclosed herein having an elongated shield member supporting a non-luminous nipple formed thereon or wedged against and which projects outwardly from one side thereof. The opposite or reverse side includes a continuous sidewall defining an internal cavity and which is closed by a cap. The cap carries a sheet of luminescent material within the cavity adhesively secured to the cap, a recessed illuminescent graphic representation or a luminescent movable article such as a ball. The luminescent material or substance is separated from and blocked from engaging or contacting the mouth of the infant.

7 Claims, 1 Drawing Sheet

FIG. 1
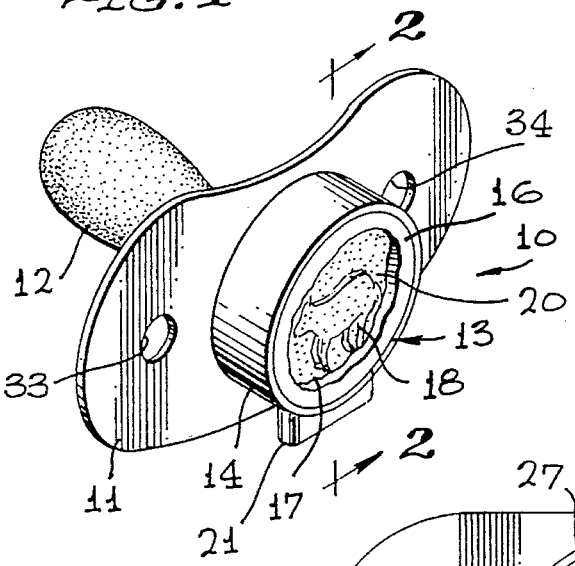
FIG. 2
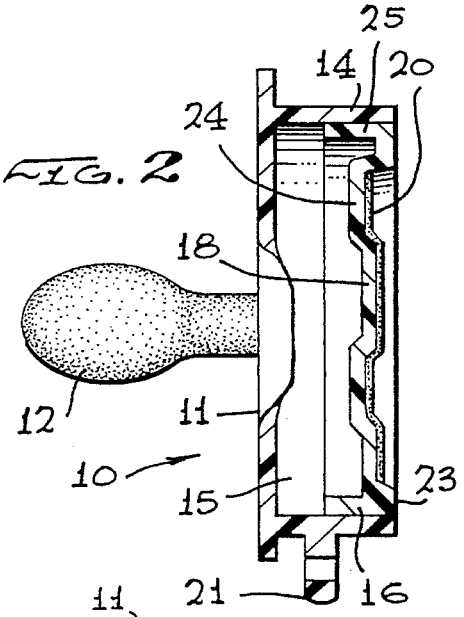
FIG. 5
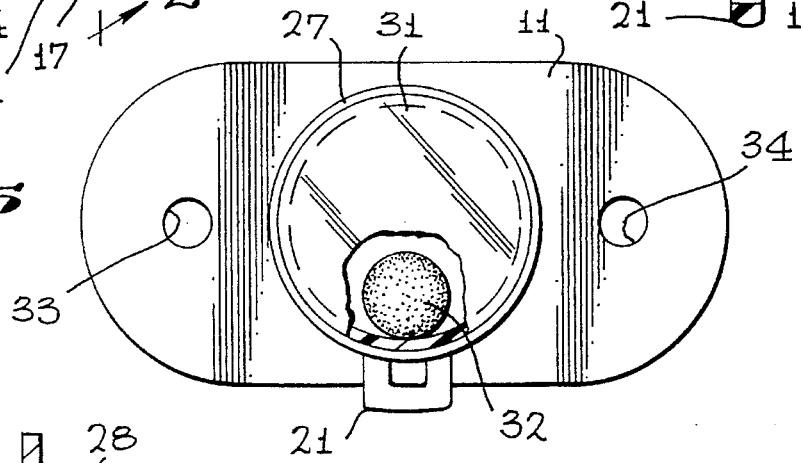
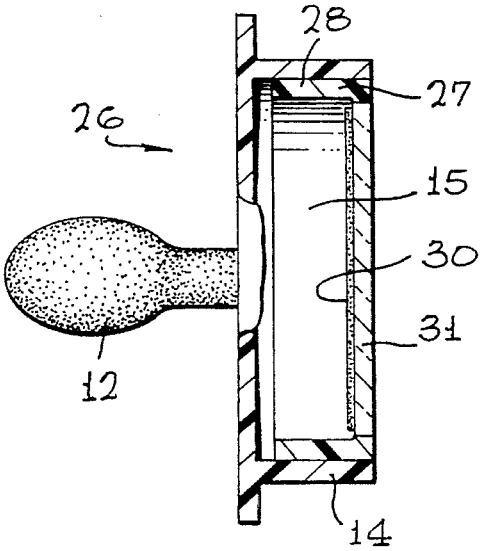
FIG. 3
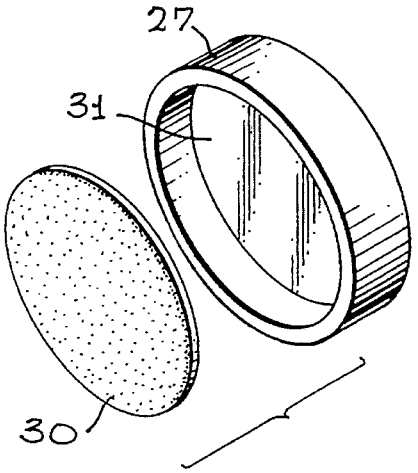
FIG. 4

LUMINESCENT PACIFIER

BACKGROUND OF THE INVENTION

1. Field of the Invention

The present invention relates to the field of luminescent pacifiers, and more particularly to a novel pacifier having illuminescent material embodied in a sheet, movable object or recessed representation which is blocked from engaging with or contacting the mouth of the user.

2. Brief Description of the Prior Art

In the past, it has been the conventional practice to employ a pacifier to soothe and maintain an infant quiet. In this connection, some attempts have been made to make the pacifier attractive or more noticeable in the dark by placing illuminescent substances or material on the pacifier which attract the attention of the infant. Some attempts to employ illuminous substances are found in the disclosures of U.S. Pat. Nos. 4,688,571; 4,716,902; and 3,186,411. Problems and difficulties have been encountered with such prior pacifiers which stem largely from the fact that the illuminescent substance is impregnated into material which the infant may bite into or place in his mouth so that the material will injure or damage the infant. In some instances, the illuminescent substance is poisonous. In these prior disclosures, it can be seen that an infant can either readily touch the illuminescent material or substance with parts of the mouth or that the illuminescence takes the form of a bulb which will readily break and present further danger to the infant.

Therefore, a long-standing need has existed to provide a novel infant pacifier which presents the attractive and noticeable features of illuminescence but which blocks or separates the illuminescent substance from the mouth of the infant so that the substance cannot enter the infant's body.

SUMMARY OF THE INVENTION

Accordingly, the above problems and difficulties are avoided by the present invention which provides a novel pacifier having a non-luminous nipple carried on one side of an elongated shield member while a continuous wall is provided on the opposite side of the shield member for supporting and carrying a cap. The cap is fixedly secured to the sidewall and defines in connection with the sidewall and the shield member, an internal cavity which may be occupied by a material containing an illuminescent substance. In one form, the material may take the form of a sheet adhesively secured to the underside of a transparent cap while in other instances, the illuminescent substance may be incorporated into a ball or other movable article which is movably contained within the cavity. In another instance, the illuminescent material may be carried on a graphic representation which is deeply recessed within the cap so as to be unavailable for contact by the infant.

Therefore, it is among the primary objects of the present invention to provide an illuminated pacifier which contains an illuminescent substance completely separated and blocked from being contacted by the infant.

Another object of the present invention is to provide an illuminated pacifier for infants which maintains the illuminescent substance at a distance from external portions of the pacifier so that the infant cannot taste, chew or otherwise come into contact with the luminous substance.

Yet another object of the present invention is to provide a novel illuminated pacifier which is attractive to an infant and wherein the luminescent material is internally disposed remote from contact with the baby's or infant's mouth.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view showing the novel illuminated pacifier for infants which incorporates the present invention;

FIG. 2 is a transverse cross-sectional view of the pacifier illustrated in FIG. 1 as taken in the direction of arrows 2—2 thereof;

FIG. 3 is a transverse cross-sectional view of another embodiment illustrating the placement of luminous material inside an internal cavity;

FIG. 4 is a perspective view of a cap or cover having a sheet of material embedded with luminous substance; and FIG. 5 is a front elevational view of another embodiment of the present invention incorporating a moving article showing luminous material or substance.

DESCRIPTION OF THE PREFERRED EMBODIMENT

Referring to FIG. 1, the novel illuminated or luminous pacifier for an infant is is indicated in the general direction of arrow 10 which includes an elongated shield 11 having a flexible nipple 12 outwardly extending from the one side of the member 11. The nipple 12 is intended to be inserted into the mouth of the infant and the infant's lips and other facial portions may engage the surface of the shield 11 carrying the nipple 12. However, the opposite side of the shield 11 contains a luminous decoration taking the form of alpha/numeric data, graphic representations or the like which are luminous so as to cast off a light in a darkened environment. Such a light or illumination is attractive to the infant and the infant immediately knows the location of the pacifier and its availability. The illuminous representation is indicated in the general direction of arrow 13, which takes the form of a continuous circular sidewall 14 defining an internal cavity, indicated by numeral 15 in FIG. 2, that is closed by a cover or cap 16. A feature of the invention resides in providing a recess 17 on the cover or lid 16 which is contoured in the form of a graphic representation such as is indicated by numeral 18. It is to be understood that the lip, cover or cap 16 is integral with the contoured recess and that the recess is well below the outer surface of the lid or cover 16. In this fashion, a coating of luminous material 20 may be placed on the graphic representation and yet is not available to the baby's mouth. In this manner, the luminescent coating 20 cannot be dislodged or engaged by the mouth of the infant. A loop 21 may be carried in a downwardly depending position from the continuous sidewall 14 through which a string tether may be placed or the loop may be employed for hanging on a hook when not in use.

Referring now in detail to FIG. 2, it can be seen that the cover or cap 16 includes an outer surface 23 which is circular and surrounds the graphic representation 18 that is carried on a panel 24. The panel 24 is surrounded by the outer surface 23 and is substantially recessed from the surface 23 so that the infant cannot reach the luminous coating 20 with tongue, teeth or other facial members. The cap or cover 16 further includes a circular sidewall 25 of reduced diameter from the diameter of the sidewall 14 so that an interference fit is produced when the cover or cap is forced into the recess 15.

Referring now in detail to FIGS. 3 and 4, another version of the invention is shown and indicated by numeral 26 which employs a cap or cover 27 composed of a transparent material and which includes an annular sidewall 28 of reduced diameter from the sidewall 14 so that the cap may be pressed into an interference fit with the sidewall during installation. The cavity 15 is partially occupied by a coating of luminescent substance or material 30 which is carried on the inside surface of a transparent panel 31 forming a face portion of the cap or cover 27. The luminescent substance 30 may take the form of a graphic representation or may simply be a coating which covers the entire inside of the panel 31. In this manner, an infant does not have access to the poisonous or harmful luminescent material 30 and is a safe device. In FIG. 4, it can be seen that the luminescent substance 30 may take the form of a solid coating or may be a disc of material which can be inserted against the transparent panel 31 so as to be joined with or carried by the cap or cover 27.

Referring now in detail to FIG. 5, another embodiment of the invention is illustrated wherein the cavity 15 is occupied by a movable object or article such as a ball, identified by numeral 32. The movable article is free to move within the cavity 15 beneath the cap or cover 27 and the luminescence of the article is visible through the transparent panel 31. Again, the infant does not have access to the movable article and therefore, the panel 31 of the cap 27 protects the infant from coming into contact with the possibly harmful luminescent substance.

The pacifier 10 may either use the loop 21, as shown in FIGS. 1, 2 and 5, or the loop need not be used, as shown in the FIG. 3. Also, apertures 33 and 34 may be placed in the shield 11 for purposes of convenience for the infant in order to break any vacuum which may be created during a suckling procedure and the apertures are also employed for lightening purposes. The material of the shield 11 as well as the cap is of high-to-strength ratio material such as plastic or the like which is non-breakable and non-shatterable. The manufacturing process may be by molding in order to provide for high production at low cost.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An illuminescent infant pacifier comprising:

an elongated shield member having opposite ends separated by a midsection;

a flexible nipple carried on said shield member midsection outwardly projecting in a cantilevered manner from a first side of said shield member;

a circular, continuous sidewall carried on said shield member midsection outwardly projecting from a second side of said shield member;

said continuous sidewall defining an internal cavity in cooperation with said shield member midsection second side;

a cover secured to said continuous sidewall enclosing said internal cavity;

illuminescent substance carried on said cover;

said cover includes a recessed panel below an outer surface of said sidewall and extending into said cavity and further including a shaped and contoured graphic representation; and said illuminescent substance disposed on said graphic representation.

2. An illuminescent infant pacifier comprising:

an elongated shield member having opposite ends separated by a midsection;

a flexible nipple carried on said shield member midsection outwardly projecting in a cantilevered manner from a first side of said shield member;

a circular, continuous sidewall carried on said shield member midsection outwardly projecting from a second side of said shield member;

said continuous sidewall defining an internal cavity in cooperation with said shield member midsection second side;

a cover secured to said continuous sidewall enclosing said internal cavity;

said cover includes a panel extending across said internal cavity which is transparent; and an illuminescent substance carried within said internal cavity.

3. The invention as defined in claim 2 including:

a disc adjacent to and adhered to said panel within said internal cavity; and said illuminescent substance disposed on said disc engaging with said panel.

4. The invention as defined in claim 2 wherein:

said illuminescent substance is a coating carried on said cover panel.

5. An illuminescent infant pacifier comprising:

an elongated shield member having opposite ends separated by a midsection;

a flexible nipple carried on said shield member midsection outwardly projecting in a cantilevered manner from a first side of said shield member;

a circular, continuous sidewall carried on said shield member midsection outwardly projecting from a second side of said shield member;

said continuous sidewall defining an internal cavity in cooperation with said shield member midsection second side;

a cover secured to said continuous sidewall enclosing said internal cavity;

said cover includes a continuous circular flange engageable with said continuous sidewall and a transparent panel extending across said circular flange closing said internal cavity;

a movable article disposed in said internal cavity adapted to be moved therein; and an illuminescent substance carried on said movable article for illumination through said panel for exterior attraction.

6. The invention as defined in claim 5 including:

a loop carried on said continuous sidewall and downwardly depending therefrom.

7. The invention as defined in claim 6 wherein:

said cover and said continuous sidewall are composed of a non-breakable and non-shattering composition.

* * * * *